US005579997A

United States Patent [19]

Jackson et al.

[11] Patent Number: 5,579,997

[45] Date of Patent: Dec. 3, 1996

[54] TOY VEHICLE TRACK SECTION WITH OVERLAPPING PIVOTED FLANGES

[76] Inventors: Jennifer K. Jackson; Terry L. Jackson, both of 1917 Shenandoah Trail, Lebanon, Tenn. 37087

[21] Appl. No.: 532,853

[22] Filed: Sep. 22, 1995

[51] Int. Cl.[6] ..... E01B 23/00

[52] U.S. Cl. ..... 238/10 R; 238/10 A; 238/10 E; 238/10 F

[58] Field of Search ..... 238/10 R, 10 A, 238/10 C, 10 E, 10 F, 151; 104/DIG. 1

[56] References Cited

U.S. PATENT DOCUMENTS

| | | | |
|---|---|---|---|
| D. 249,737 | 9/1978 | Tong | D21/143 |
| D. 261,292 | 10/1981 | Tong | D21/143 |
| D. 264,108 | 4/1982 | Tong | D21/143 |
| D. 281,002 | 10/1985 | Olsen | D21/143 |
| D. 281,443 | 11/1985 | Olsen | D21/143 |
| D. 297,747 | 9/1988 | Leung | D21/143 |
| D. 325,758 | 4/1992 | Black | D21/143 |
| D. 344,304 | 2/1994 | Hemmelsbach | D21/129 |
| 3,438,145 | 4/1969 | Genin | 238/10 F |
| 3,463,393 | 8/1969 | Fischer | 238/10 R |
| 3,464,624 | 9/1969 | Christiansen | 238/10 R |
| 3,562,950 | 2/1971 | Genin | 238/10 E |
| 3,592,384 | 7/1971 | Tomaro | 238/200 |
| 3,650,468 | 3/1972 | Ewe et al. | 238/10 E |
| 3,750,945 | 8/1973 | Warr | 238/10 E |
| 4,355,776 | 10/1982 | Rydin | 246/415 A |
| 4,496,100 | 1/1985 | Schwager et al. | 238/10 F |
| 4,540,119 | 9/1985 | Neuhierl | 238/10 F |
| 4,544,094 | 10/1985 | Scholry | 238/10 F |
| 4,665,833 | 5/1987 | Fleishman et al. | 104/301 |
| 4,771,943 | 9/1988 | Cooney et al. | 238/10 E |
| 4,841,104 | 6/1989 | Adell | 238/10 E |
| 4,941,610 | 7/1990 | Frauca | 238/10 E |
| 4,993,631 | 2/1991 | Niehoff | 238/10 E |
| 5,139,198 | 8/1992 | Niehoff | 238/10 E |
| 5,295,442 | 3/1994 | Carpenter | 105/176 |
| 5,427,561 | 6/1995 | Eichhorn et al. | 104/DIG. 1 |

OTHER PUBLICATIONS

1995 Product Brochure for Thomas The Tank Engine & Friends™ Wooden Railway System by Learning Curve Toys, pp. 1–3, 8–9,20.

Product Brochure for BRIO Wooden Railway by BRIO Corporation, pp. 1, 16–19,28.

*Primary Examiner*—S. Joseph Morano

*Attorney, Agent, or Firm*—Wascher & Thomas, PLLC; Rick R. Wascher; Laura K. Thomas

[57] ABSTRACT

A track section for pivotally interconnecting sections of toy vehicle track comprising at least two pivotally attached segments, each segment having a top surface, a bottom surface, and spaced apart ends. The track section further comprises cooperating rails that form a substantially continuous path for guiding the movement of a toy vehicle when one segment is positioned at an angle relative to another of the at least two segments. The rails partially define a pair of spaced apart parallel channels along with a median on the top surfaces of the segments. The track section includes a coupling device comprising a prong protruding from one end of one of the segments along a central longitudinal axis, and a socket formed in one end of the other segment along a central longitudinal. The other ends of the segments include a connecting device comprising a cooperating flange and recess for pivotally connecting the segments wherein the flange of each segment is received within the recess of the other segment.

18 Claims, 4 Drawing Sheets

TOY VEHICLE TRACK SECTION WITH OVERLAPPING PIVOTED FLANGES

BACKGROUND OF INVENTION

1. Field of the Invention

The present invention relates generally to toy vehicle tracks, but more particularly to track sections for connecting sections of track such that the sections of track connected adjacent the inventive track section are pivotal relative to one another.

2. Description of the Related Art

The art to which the present invention relates includes toy vehicle track assemblies, particularly track assemblies for toy trains. From their earliest conception in the late 1800's, toy trains have captured the interest of children and adults alike, and have provided untold hours of amusement and enjoyment. Both children and adults have been known to invest tremendous amounts of effort in constructing elaborate track systems that include bridges, tunnels, train stations, and a number of other accessories which are intended to provide a more "realistic" dimension to the layout. Thus, one of the most significant features of toy train sets and other toy vehicle sets is a track system that includes components that may be easily assembled into a variety of configurations.

In addition to train cars and other accessory pieces, toy vehicle and train sets typically include a set of interconnecting track components of different sizes and shapes useful for constructing different track configurations. The set usually includes assorted sections or lengths of track that are straight, curved, ascending, etc. The ends of each section of track are configured to interconnect such that adjacent sections of track may be joined end-to-end to form a continuous track on which the train can travel. Accordingly, a user may construct a variety of track configurations, each having a unique travel pattern, simply by arranging and joining the track sections in different combinations.

The track components of conventional toy vehicle and train sets typically include only a few different section or length configurations (e.g. straight or curved) and, thus, provide limited possibilities for varying the overall track configuration. Moreover, when a user attempts to incorporate track sections that are curved to different radiuses, he or she often finds that the last two sections of track do not line up properly to permit interconnection, and that none of the "standard" track sections are appropriately configured to bridge the gap.

The art to which the present invention relates includes wooden railway components manufactured by Brio Corporation and sold under the trademark BRIO® Wooden Railway. The BRIO® components include straight and curved track pieces of various lengths, ramped track, ascending track, graded supports, buffer stops, short curved switches, switching and crossing tracks, switching tracks, curved switching tracks, double curved switching tracks, and other accessory pieces.

Also included in the art to which the present invention relates is the Thomas The Tank Engine & Friends™ Wooden Railway System manufactured Learning Curve Toys. The Thomas the Tank system includes straight and curved track pieces, switching tracks, cross tracks, curved switching tracks, ascending track, track adapters, graded track risers, turntables and other accessory pieces similar to those of the BRIO® system.

U.S. Pat. No. 4,993,631 and U.S. Pat. No. 5,139,198 granted to Niehoff, which are incorporated by reference as if fully set forth herein, are directed to a model train track for electrical model trains comprising an oblong track body with trapezoidal section and ballast structure, on the top side of which two metal rails are fastened on railroad ties, the body having a lower side serving as a support and two end face connection zones for the electrical and mechanical connection of adjacent rail pieces. The track further comprises a symmetrical connecting member consisting of two heads of identical design, which are intended to be received by a recess in the track sections, and a web of smaller cross section. The connecting member is inserted from the bottom into the recesses of adjacent sections of straight track.

U.S. Pat. No. 3,438,145, granted to Genin, which is incorporated by reference as if fully set forth herein, is directed to a toy railroad track assembly comprising a figure-of-eight section formed by a pair of symmetrically-arranged annular guide channels which communicate with each other through an isthmus, one bank of which is formed by a cusp-shaped, removable sub-section whose converging guide walls are common to said annular guide channels, such that when said sub-section is withdrawn, the annular guide channels are converted into a single, flow-through channel acting to interconnect associated track sections coupled to the end ports in the figure-of-eight section.

The list that follows is directed to a variety of toy trains and track assemblies found in the related art.

| U.S. Pat. No. | Inventor |
|---|---|
| 3,463,393 | Fischer |
| 3,464,624 | Christiansen |
| 3,562,950 | Genin |
| 3,592,384 | Tomaro |
| 3,650,468 | Ewe et al. |
| 4,355,776 | Rydin |
| 4,665,833 | Fleishman et al. |
| 4,771,943 | Cooney et al. |
| 4,841,104 | Adell |
| 5,295,442 | Carpenter |
| D249,737 | Tong |
| D261,292 | Tong |
| D264,108 | Tong |
| D281,002 | Olsen |
| D281,443 | Olsen |
| D297,747 | Leung |
| D325,758 | Black |
| D344,304 | Hemmelsbach |

Until now, it is believed that a toy vehicle track connecting member useful for interconnecting adjacent sections or lengths of track such that the adjacent sections of track are pivotal into a variety of different positions relative to one another has not been invented.

SUMMARY OF THE INVENTION

The present invention is directed to a track section for pivotally interconnecting sections of toy vehicle track. The preferred embodiment of the track section of the present invention comprises a pair of pivotally attached segments. The pivotal attachment of the segments enables the user to rotate sections of track, which are connected at either end of the inventive track section, into a wide range of angular orientations to accommodate different track configurations.

The configuration of standard track pieces limits the number of different track configurations that are possible because the sections are either straight or curved to one particular radius. The standard curved track section may not be curved to the radius required to "close the loop" of a particular track configuration. The present invention, however, is useful for closing the loop of a particular track configuration when standard track pieces will not do so.

In the preferred embodiment, the inventive track section is constructed of wood; however, it may be constructed of other materials, including metal or synthetic materials such as plastic, rubber, polymers, composites or any other material suitable for the intended purpose.

In addition, the preferred embodiment of the present invention includes a prong- and-socket system or coupling system for connecting adjacent track sections; however, other coupling means for engaging adjacent track sections, such as snap-fit or other male-female type connections, are contemplated to be within the scope of the invention.

The track section includes at least two segments, each segment having a top surface, a bottom surface and spaced apart ends. In the preferred embodiment, the track section includes coupling means comprising a prong protruding from one end of one of the segments along a central longitudinal axis of the segment, and a socket configured to receive a prong formed in one end of one of the other segments along a central longitudinal axis of the segment. The prong and socket are configured to receive other mating sections of track.

In the preferred embodiment, the segments further comprise a cooperating flange and recess configuration wherein each segment includes a flange and a recess configured to cooperate with a flange and a recess of at least one of the other segments such that the flange of one segment is received within the recess of the other segment and vice versa. Accordingly, a flange, having an end curved in a convex manner and having a radius R extending from a centroid or point of origin, protrudes from the top surface of the end opposite the coupling means of one of the segments. The height of the flange is less than the height of the segment. A bore for receiving a fastener extends through the centroid or origin of the flange of the segment. A portion of the bottom surface of the segment is cut away to form a recess opposite the flange. The bottom surface of the flange defines the bottom surface of the recess. The end of the recess opposite the convex end of the flange is curved in a concave manner.

A flange, having an end curved in a convex manner and having a radius R extending from a centroid or point of origin, protrudes from the bottom surface of the end opposite the coupling means of one of the other segments. The height of the flange is less than the height of the segment. A bore for receiving a fastener extends through the centroid or origin of the flange of the segment. A portion of the top surface of the segment is cut away to form a recess opposite the flange. The top surface of the flange defines the bottom surface of the recess. The end of the recess opposite the convex end of the flange is curved in a concave manner.

When the flanges and recesses of mating segments are cooperatively engaged such that the flange of one segment is received within the recess of the other segment (and vice versa), the flanges are positioned in parallel planes such that flange of one segment overlaps the flange of the other segment. Accordingly, the bores extending through the flanges align to receive a fastener, such as a pin, rivet, screw, or bolt. The prong and socket comprising the coupling means of the preferred embodiment may be positioned on either one of mating segments irrespective of the orientation of the flanges.

While the preferred embodiment of the inventive track section includes cooperatively configured flanges and recesses interengaged in a manner that permits horizontal pivotal movement of the segments, other cooperative configurations for pivotally attaching the segments are contemplated to be within the scope of the present invention.

Rail means comprising a pair of spaced apart parallel channels configured to accommodate the wheels of a train are formed in the top surfaces of the pronged segment and the socketed segment. In the preferred embodiment, the channels are formed by siderails and a median. The channels formed in each segment align so that a continuous path is formed for the wheels of a train.

The channels widen as they approach the points where the channels of the pronged segment meet the channels of the socketed segment (i. e., the section of the track interpositioned between the medians of the two pivotally connected segments) so that a continuous path may be maintained as one segment is pivoted with respect to the other segment. Thus, as the channels widen, the width of the median of each segment tapers correspondingly to a point. The tapered median guides the wheels of the train when one of the segments is positioned at an angle relative to the other segment.

In an alternate embodiment of the track section, one of the segments comprises a switching track segment having rail means that diverge to form a plurality of paths for the wheels of a train, wherein the switching track segment is pivotally attached to each of a plurality of segments cooperatively configured as described hereinabove to form a plurality of continuous paths. Accordingly, each of the plurality of paths is capable of pivotal adjustment to a range of different angular configurations by virtue of the pivotal attachment of the mating segment to the first segment. The ends of the segments opposite the pivotal attachment further comprise coupling means as described hereinabove.

Of course, other track section configurations (e.g. curved, s-shaped, etc.) which incorporate pivotally attached segments as described hereinabove are contemplated to be within the scope of the present invention.

The present invention may, therefore, be summarized in a variety of ways, one of which is the following: a toy vehicle track section for connecting sections of toy vehicle track, comprising at least two pivotally attached segments having cooperating rail means for guiding the movement of a toy vehicle, wherein the rail means of the at least two segments form a substantially continuous guideway when one of the at least two segments is positioned at an angle relative to another of the at least two segments. The rail means further comprises a pair of spaced apart parallel channels formed in a top surface of each of the at least two segments.

The at least two segments further comprise connecting means for pivotally attaching each of the segments to at least one other segment. The connecting means further comprises a flange extending from each of the segments, each flange having a convex end curved to a radius extending from a point of origin; a recess formed in each of the segments adjacent the flange wherein the recesses have concave ends opposite the convex ends of the flanges; wherein the flange of at least one segment of the at least two segments is received within the recess of another of the at least two segments and the flanges are positioned in parallel planes when cooperatively engaged; and a pivot member.

The track section also includes coupling means for attaching the track section to another section of track. The coupling means further comprises a prong protruding from an end of at least one of the segments of the at least two pivotally attached segments, and a socket formed in an end of at least one of the other segments of the at least two pivotally attached segments.

Yet another way of summarizing the invention is: a toy vehicle track section, comprising at least two track segments, each segment having a centerline and spaced apart ends; pivot means interpositioned between the track segments for pivotally connecting the track segments in an end-to-end relationship; and cooperating rail means associated with the track segments for steering a vehicle along the track section. The rail means further comprises a pair of spaced apart parallel side rails. A channel is partially bounded by the pair of spaced apart parallel side rails, and the channel receives a portion of the toy vehicle. A median is positioned along a centerline of the at least two track segments.

The track section includes coupling means for attaching the track section to another track section. The coupling means further comprises a prong protruding from an end of at least one of the track segments, and a socket for receiving a prong formed in an end of at least one of the other track segments.

The means for pivotally connecting further comprises a cooperating flange and recess wherein the flange of each segment is received within the recess of one of the other segments. The track segments are attached at an origin of the flanges.

A third way of summarizing the invention is: a toy vehicle track section, comprising at least two pivotally attached segments, each segment having a top surface and spaced apart ends; and rail means for guiding the movement of a toy vehicle wherein the rail means forms a substantially continuous guideway to guide the movement of a toy vehicle along a path parallel to a centerline of the track section. The segments further comprise cooperatively configured pivot means for attaching each of the segments together. The track section further comprises coupling means for attaching the track section to another section of track.

It is an object of the present invention to provide a track section for toy vehicle tracks or railway sets capable of horizontal pivotal adjustment to permit the pivotal movement of sections of track adjacent the inventive track section into a wide range of angular orientations to accommodate different track configurations.

It is another object of the present invention to provide a track section for toy vehicle tracks or railways useful for "closing the loop" of a particular track configuration when commercially available track pieces will not do so.

It is yet another object of the present invention to provide a track section for use with toy vehicle tracks or railways comprising at least two segments pivotally attached and having ends configured to connect to other commercially available pieces of track.

These and other objects, features and advantages shall become apparent after consideration of the description and drawings set forth herein. All such objects, features and advantages are contemplated to be within the scope of the present invention even though not specifically set forth herein.

BRIEF DESCRIPTION OF THE DRAWINGS

FIG. 1;

DESCRIPTION OF THE PREFERRED EMBODIMENTS

Figure 1:
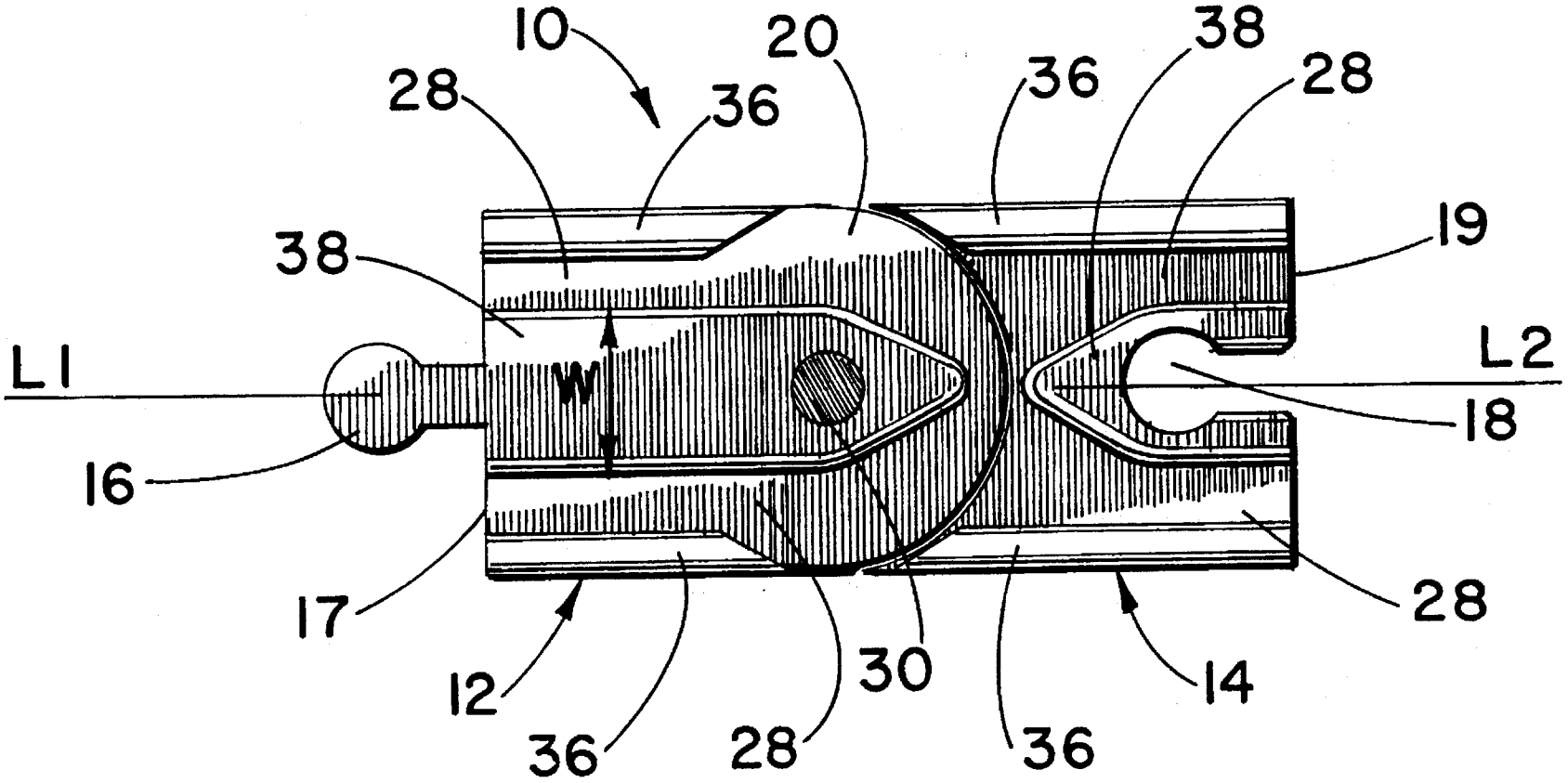
FIG. 1 is an elevated top perspective view of an embodiment of the present invention.
Figure 2:
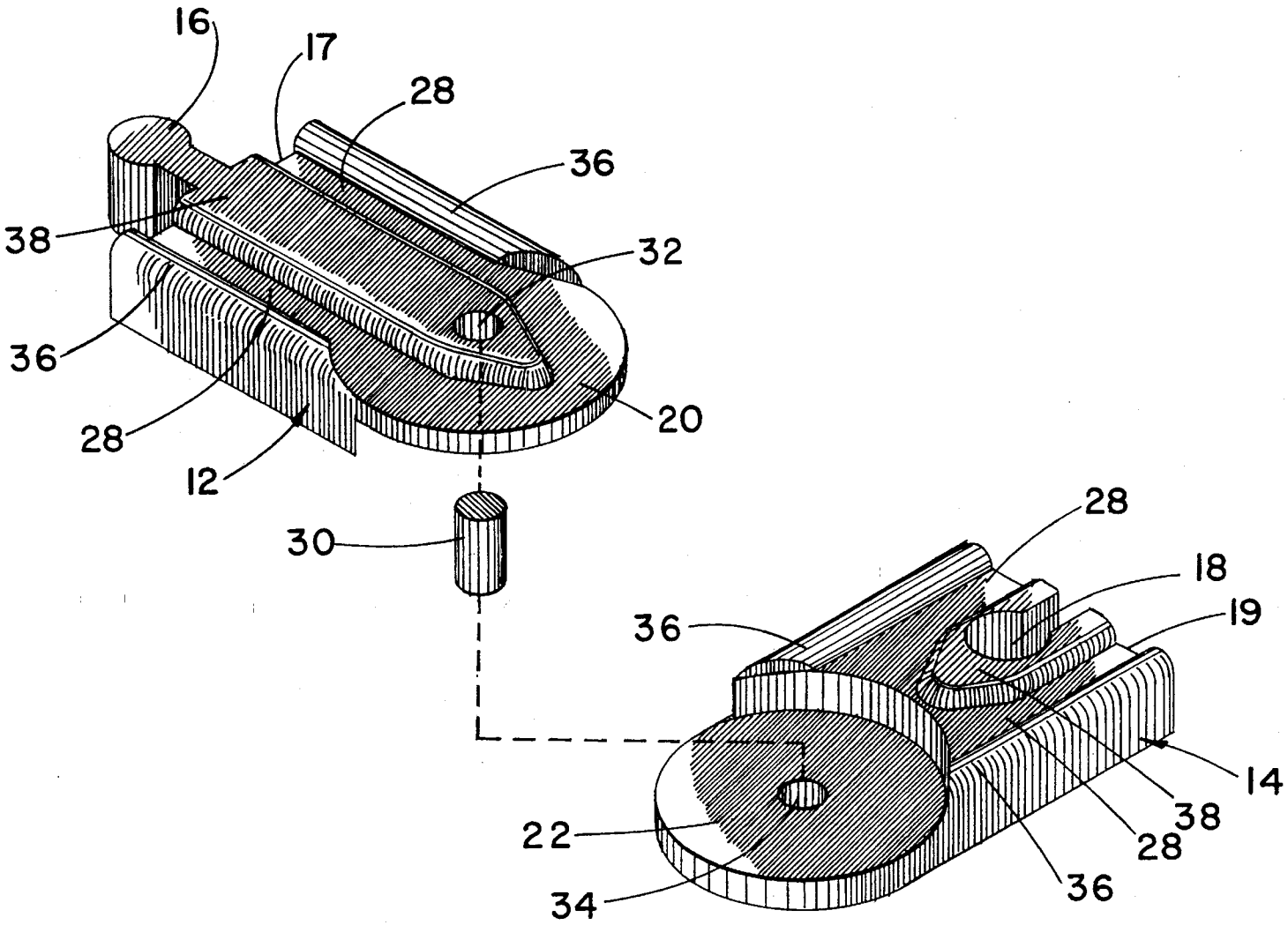
FIG. 2 is an exploded view of the invention of FIG. 1 shown in an alternate position.

An embodiment of the present invention is designated generally by the reference numeral 10 in FIGS. 1 and 2. Track section 10 includes at least two pivotally attached segments 12 and 14, each segment having a top surface 24, a bottom surface 26 and spaced apart ends (see FIGS. 1 and 6). In the preferred embodiment, the track section 10 includes coupling means 13 comprising a prong 16 protruding a distance from one end 17 of a first segment 12 along a central longitudinal axis or centerline L1 (see FIGS. 1 and 3), and a socket 18 configured to receive a prong 16 formed in one end 19 of a second segment 14 along a central longitudinal axis or centerline L2 (FIGS. 1 and 4) for attaching the track section 10 to another track section 52. The central longitudinal axes L1 and L2 merge to form a centerline when the longitudinal axes L1 and L2 of the at least two segments are positioned parallel.

Figure 5:
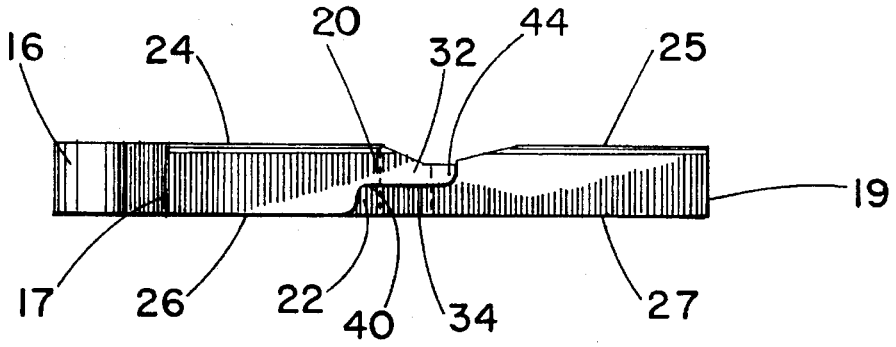
FIG. 5 is a side view of the embodiment of the invention shown in FIG. 1.

In the preferred embodiment, a flange 20, having an end curved in a convex manner and having a radius R extending from a centroid or point of origin 46, protrudes from the top surface 24 of the other end of the first segment 12 (see FIGS. 1 and 5). Similarly, a flange 22, having an end curved in a convex manner and having a radius R extending from a centroid or point of origin 46, protrudes from the bottom surface of the other end of the second segment 14 (see FIGS. 5 and 6).

Figure 6:
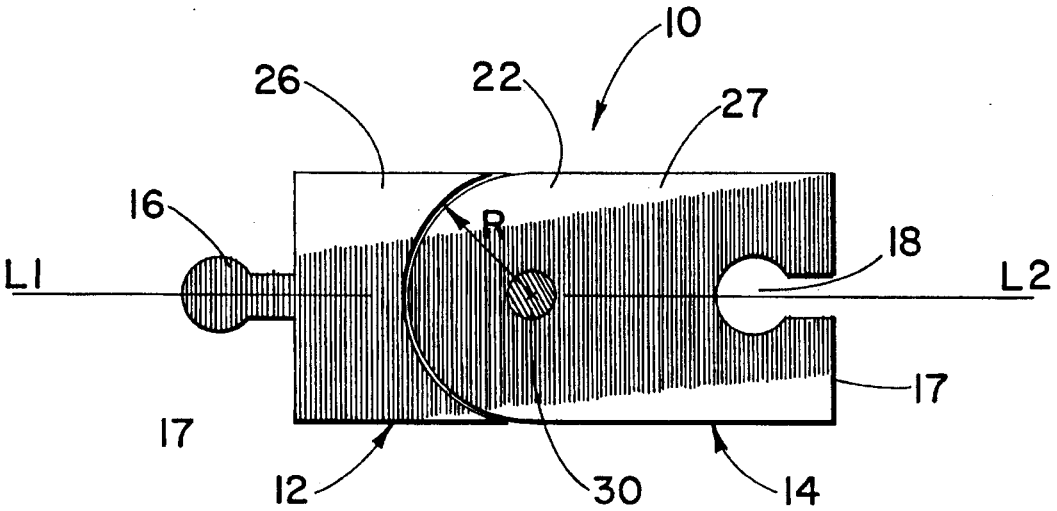
FIG. 6 is an elevated bottom perspective view of the embodiment of the invention shown in FIG. 1.

With reference to FIG. 5, the flange 20 has a height H1 which is less than the height H2 of the first segment 12. A bore 32 for receiving a fastener 30, which serves as a pivot axis, extends through the flange 20 of the first segment 12. A portion of the bottom surface 26 of the first segment 12 is cut away to form a recess 40 opposite the flange 20 (FIG. 6). The bottom surface 41 of the flange 20 defines the bottom surface of the recess 40. The end of the recess 40 opposite the convex end of the flange 20 is curved in a concave manner.

Similarly, the flange 22 has a height H3 which is less than the height H2 of the second segment 14. A bore 34 for receiving a fastener 30 extends through the flange 22 of the second segment 14. A portion of the top surface 25 of the second segment 14 is cut away to form a recess 44 opposite the flange 22. The top surface 45 of the flange 22 defines the bottom surface of the recess 44. The end of the recess 44 opposite the convex end of the flange 22 is curved in a concave manner.

The flange 20 of the first segment 12 is configured to be received within the recess 44 of the second segment 14 (FIGS. 1 and 5), and the flange 22 of the second segment 14 is configured to be received within the recess 40 of the first segment 12 (FIGS. 5 and 6) to permit pivotal movement in a horizontal plane of one segment with respect to the other. In this manner, flanges 20 and 22 are positioned in parallel planes such that flange 20 overlaps flange 22. Accordingly, bores 32 and 34 align to receive fastener 30 (FIG. 5). Attachment by any suitable means for pivotally attaching the segments, including a pin, rivet, screw, or bolt, is contemplated.

Alternatively, the flange 20 of the first segment 12 may protrude from the bottom surface 26 of the first segment 12, and the recess 40 may be formed in the top surface 24. Accordingly, the flange 22 of the second segment 14 may protrude from the top surface 25 of the second segment 14, and the recess 44 may be formed in the bottom surface 27. In this embodiment, flanges 20 and 22 are also positioned in parallel planes, however, flange 22 overlaps flange 20. In other words, the coupling means 13 (i.e. the prong 16 and socket 18) may be positioned on either of the segments irrespective of the orientation of the flanges 20 and 22.

Figure 3:
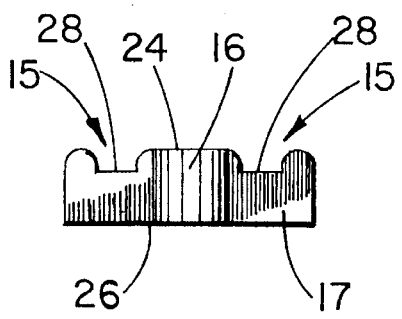
FIG. 3 is a left end view of the embodiment of the invention shown in FIG. 1.
Figure 4:
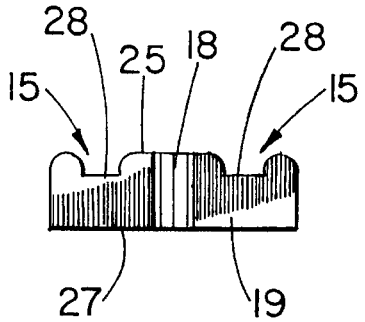
FIG. 4 is a right end view of the embodiment of the invention shown in FIG. 1.

With reference to FIGS. 1, 3 and 4, rail means 15 comprising a pair of spaced apart parallel channels 28 configured to receive the wheels of a train are formed in the top surfaces 24 and 25 of the pronged segment 12 and the socketed segment 14, respectively. In the preferred embodiment, the channels 28 are formed by side rails 36 and a median 38 having a width W. The channels 28 formed in each segment align to form substantially continuous channels for the wheels of a train.

The channels 28 widen as they approach the points where the channels 28 of the pronged segment 12 meet the channels 28 of the socketed segment 14 so that a continuous path may be maintained as the pronged segment is pivoted with respect to the socketed segment (or vice versa). As the channels 28 widen, the widths W of the medians 38 of the pronged segment 12 and the socketed segment 14 taper correspondingly to points 42.

Figure 7:
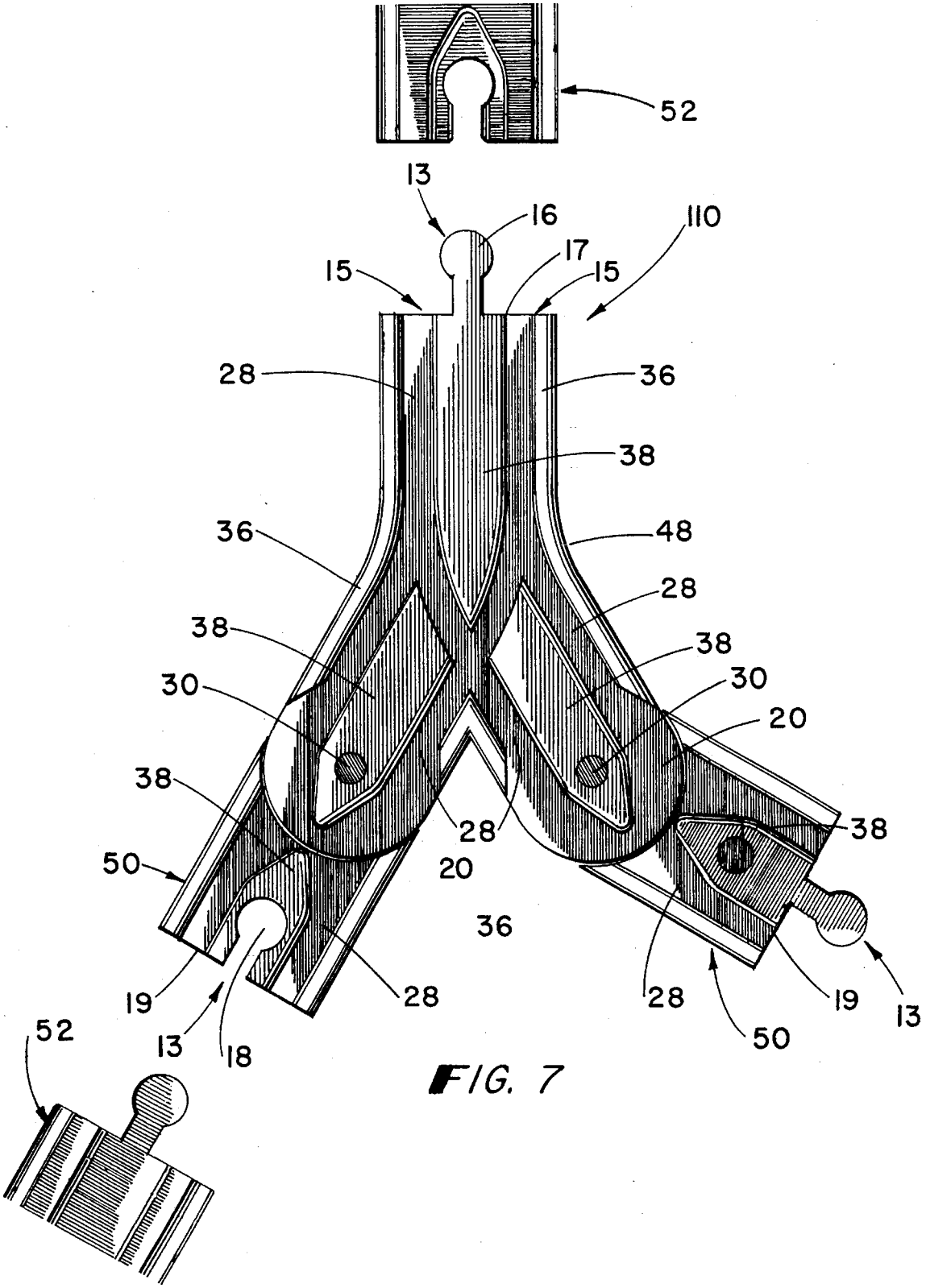
FIG. 7 is an elevated top perspective view of an alternate embodiment of the present invention.

In an alternate embodiment of the track section 110 (see FIG. 7), one of the segments further comprises a switching track segment 48 having rail means 15 that diverge to form a plurality of paths for the wheels of a train, wherein the switching track segment 48 is pivotally attached to each of a plurality of segments 50 cooperatively configured as described hereinabove to form a plurality of continuous paths. Accordingly, each of the plurality of paths is capable of pivotal adjustment to a range of different angular configurations by virtue of the pivotal attachment of the mating segment to the first segment. The ends 17 and 19 of the segments 48 and 50 opposite the pivotal attachment, respectively, further comprise coupling means 13 as described hereinabove.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected by the appended claims.

What is claimed is:

1. A toy vehicle track section for connecting additional sections of toy vehicle track, comprising:

at least two pivotally attached segments having cooperating rail means for guiding the movement of a toy vehicle, wherein the rail means of the at least two segments form a substantially continuous guideway when one of the at least two segments is positioned at an angle relative to another of the at least two segments; and connecting means for pivotally attaching the at least two segments, the connecting means comprising cooperatively configured overlapping flanges attached with a pivot member extending through the flanges of each of the at least two segments.

2. The track section of claim 1 wherein the rail means further comprises:

a pair of spaced apart parallel channels formed in a top surface of each of the at least two segments.

3. The track section of claim 1 further comprising:

coupling means for attaching the track section to one of said additional sections of track.

4. The track section of claim 3 wherein the coupling means further comprises a prong protruding from an end of at least one of the segments of the at least two pivotally attached segments.

5. The track section of claim 3 wherein the coupling means further comprises a socket formed in an end of at least one of the other segments of the at least two pivotally attached segments.

6. The track section of claim 1 wherein:

each flange includes a convex end curved to a radius extending from a point of origin;

each segment includes a recess formed therein adjacent the flange, each of the recesses having a concave end opposite the convex end of the flange; and the flange of at least one segment of the at least two segments is received within the recess of another of the at least two segments such that the flanges are positioned in parallel planes when cooperatively engaged.

7. The track section of claim 1 wherein the segments are constructed of a material selected from the group of materials consisting of wood, plastic, metal, rubber and composites.

8. A toy vehicle track section, comprising:

at least two track segments, each segment having a centerline and spaced apart ends;

connecting means for pivotally attaching the at least two track segments, the connecting means comprising cooperatively configured flanges extending from an end of each of the at least two segments and a pivot pin extending through the flanges for pivotally connecting the track segments in an end-to-end relationship such that the flanges are attached in overlapping pivotal engagement with one another; and cooperating rail means associated with the track segments for steering a vehicle along the track section.

9. The track section of claim 8 wherein the cooperating rail means further comprises:

a pair of spaced apart parallel side rails.

10. The track section of claim 9 wherein the cooperating rail means further comprises:

a channel partially bounded by the pair of spaced apart side rails, wherein the channel receives a portion of the vehicle.

11. The track section of claim 9 wherein the rail means further comprises:

a median positioned along the centerline of the at least two track segments.

12. The track section of claim 8 further comprising:

coupling means for attaching the track section to another section of track.

13. The track section of claim 12 wherein the coupling means further comprises a prong protruding from an end of at least one of the track segments, and a socket for receiving a prong formed in an end of another of the at least two segments.

14. The track section of claim 8 wherein the segments are constructed of a material selected from the group of materials consisting of wood, plastic, metal, rubber and composites.

15. The track section of claim 8 wherein the ends of the flanges are convex and wherein the connecting means further comprises a recess formed on each of the segments adjacent the flange, the recess having a concave end for cooperatively receiving the flange of another segment.

16. A toy vehicle track section, comprising:

at least two pivotally attached segments, each segment having a top surface, a bottom surface, spaced apart ends and a flange protruding from one of the ends, wherein the flanges of the at least two segments are cooperatively configured and positioned in overlapping engagement with one another;

rail means formed on the top surface of each of the at least two segments for guiding the movement of a toy vehicle, wherein the rail means forms a substantially continuous guideway to guide the movement of a toy vehicle along a path parallel to a centerline of at least one of the segments; and a pivot member extending through the flanges for pivotally attaching the at least two segments.

17. The track section of claim 16 further comprising:

coupling means for attaching the track section to another section of track.

18. The track section of claim 16 wherein the flange of each of the at least two segments is received within a cooperatively configured recess formed adjacent the flange of another segment to which it is attached.

* * * * *